US006594126B1

(12) United States Patent
Mallonen et al.

(10) Patent No.: US 6,594,126 B1
(45) Date of Patent: Jul. 15, 2003

(54) METHOD AND APPARATUS FOR EXTINGUISHING AN ARC THROUGH MATERIAL SURFACE ABLATION

(75) Inventors: Edward A. Mallonen, New Berlin, WI (US); David J. Benard, Newbury Park, CA (US); Paul T. Nolden, Racine, WI (US); Mark Clayton, Camarillo, CA (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 399 days.

(21) Appl. No.: 09/676,204

(22) Filed: Sep. 29, 2000

Related U.S. Application Data

(63) Continuation-in-part of application No. 09/219,726, filed on Dec. 22, 1998.

(51) Int. Cl.[7] ..... H01H 9/30

(52) U.S. Cl. ..... 361/13; 361/8; 218/38; 218/158

(58) Field of Search ..... 361/4, 5, 8, 9, 361/13, 14, 106; 335/35–38, 41, 208; 218/34, 37, 38, 40, 155–158

(56) References Cited

U.S. PATENT DOCUMENTS 4,485,283 A * 11/1984 Hurtle ..... 218/22
5,587,861 A * 12/1996 Wieloch et al. ..... 361/14
5,614,881 A * 3/1997 Duggal et al. ..... 338/22 R
5,877,467 A * 3/1999 Arnold et al. ..... 218/148

* cited by examiner

*Primary Examiner*—Ronald W. Leja
(74) *Attorney, Agent, or Firm*—Patrick S. Yoder; Alexander M. Gerasimow; William R. Walbrun

(57) ABSTRACT

A technique is provided for forcing greater voltage investment in an arc developed during interruption of a current carrying path. A source element is provided in a secondary current carrying path parallel to a primary path through the device. Upon interruption of the primary current carrying path, an arc is forced to migrate towards a dissipating structure under the influence of an electromagnetic field. The source material then begins to carry current and undergoes surface ablation, releasing gas which is directed towards the migrating arc. The arc is thus caused to expand further, increasing voltage investment and resulting in more rapid extinction and reduction in let-through energy.

36 Claims, 8 Drawing Sheets

METHOD AND APPARATUS FOR EXTINGUISHING AN ARC THROUGH MATERIAL SURFACE ABLATION

CROSS REFERENCE TO RELATED APPLICATIONS

The present application is a Continuation-In-Part of U.S. patent application Ser. No. 09/219,726, entitled "Method for Interrupting An Electrical Circuit," filed on Dec. 22, 1998.

BACKGROUND OF THE INVENTION

The present invention relates generally to the field of circuit interrupting devices. More particularly, the invention relates to a technique for enhancing interruption through such a device by gas dynamically forcing expansion of an arc by means of surface ablation of a source element.

Various circuit interrupters are currently available and have been developed for interrupting a current carrying path between a source of electrical power and a load. In general, such devices include one or moveable contacts and a mating contact. The contacts are joined to complete a current carrying path through the device during normal operation. The contacts may be separated, such as in response to overcurrent conditions, loss of phase, ground faults, or other unwanted events. Upon displacement of the moveable contact from its mating contact, an arc develops which is caused to expand and migrate towards a dissipating structure, such as a splitter plate stack. In general, a goal in such devices is to interrupt current as quickly as possible, to limit let-through energy and thereby to provide enhanced protection to downstream circuitry.

Approaches to rapid extinction of arcs circuit interrupters have taken various strategies. For example, devices have been proposed which cause rapid expansion of an arc by movement of the moveable contact or by movement of both mating contacts. The expansion of the arc may also be driven by electromagnetic means, such as a core structure which develops a magnetic field during interruption. While such approaches are useful in enhancing performance, further improvement is needed in circuit interrupters. There is, at present, a need for additional techniques to cause higher voltage investment in an expanding arc, and to force a further expansion of the arc to extinguish the arc even more quickly, and thereby to further limit let-through energy.

SUMMARY OF THE INVENTION

The present invention provides a novel technique for interrupting current through a circuit interrupter designed to respond to Such needs. The approach may be implemented in a variety of device configurations, including in devices which develop a single arc and in those which develop a pair of arcs by displacement of a conductive bridge or spanner. In accordance with aspects of the technique, the arc developed during circuit interruption is driven in a desired direction, typically toward a dissipating structure, such as a splitter plate stack. The arc may be driven in a variety of manners, such as electromagnetically by a field developed around a circuit interruption initiator. A source element undergoes surface ablation during the interruption event to provide a flow of gas which is directed toward the arc. The gas opposes the direction of migration of the arc, forcing expansion of the arc and more rapid extinction.

In a preferred embodiment described, the source element is provided in a second current carrying path which is parallel to the primary current carrying path in which the moveable contact is situated. The primary current carrying path supports all current through the device during normal operation, with no current through the parallel current path. During circuit interruption, current is partially directed through the parallel path including the source element, causing heating and surface ablation of the source element. Gas released by the surface ablation is directed toward the arc, which is forced to migrate in the direction of the source, element. The source element may be a material which transitions from a first resistance level to a second, higher resistance level due to heating, thereby protecting the source element from damage during operation. Where a conductive spanner or bridge is provided, source elements may be provided on either side of the spanner to direct flow of gas in the direction of a pair of arcs, both expanding and migrating toward dissipating structures on either side of the spanner.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
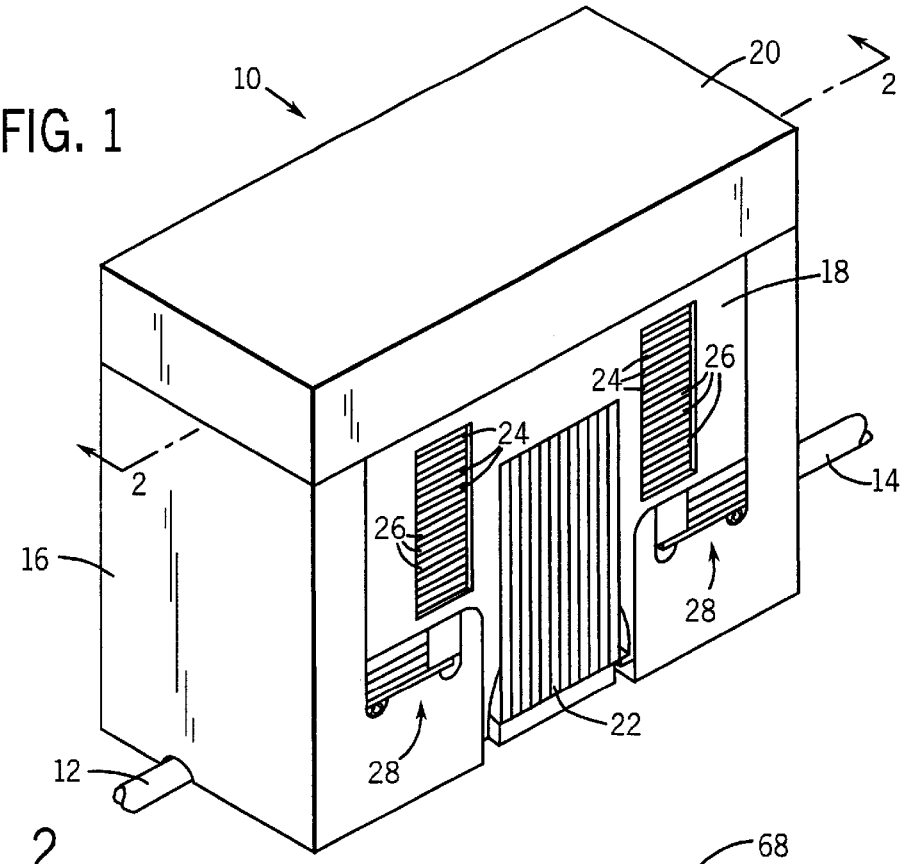
FIG. 1 is a perspective view of a circuit interrupter in accordance with the present technique for selectively interrupting an electrical current carrying path between a load and a source.

Turning now to the drawings, and referring first to FIG. 1, a modular circuit interrupter is represented and designated generally by the reference numeral 10. The circuit interrupter is designed to be coupled to an incoming or source conductor 12 and to an outgoing or load conductor 14, and to selectively complete and interrupt current carrying paths between the conductors. The interrupter module as illustrated in FIG. 1 generally includes an outer housing 16 and an inner housing 18 in which the functional components of the module are disposed as described in greater detail below. Outer housing 16 is covered by a cap 20.

It should be noted that the circuit interrupter module 10, shown in FIG. 1, is subject to various adaptations for incorporation into a wide variety of devices. For example, the interrupter module, and variants on the structure described below, may be incorporated into single phase or multi-phase interrupting devices such as circuit breakers, motor protectors, contactors, and so on. Accordingly, the module may be associated with a variety of triggering devices for initiating interruption, as well as with devices for preventing closure of the current carrying path following interruption. A range of such devices are well known in the art and may be adapted to function in cooperation with the module in accordance with the techniques described herein. Similarly, while in the embodiment described below a movable conductive element in the form of a spanner extends between a pair of stationary conductive elements or contacts, adaptations to the structure may include a movable element which contacts a single stationary element, or multiple movable elements which contact one another.

Returning to FIG. 1, also visible in this view is an interrupt initiator assembly, designated generally by the reference numeral 22. As described below, in the illustrated embodiment the initiator assembly causes initial interruption of a normal or first current carrying path through the device under the influence of an electromagnetic field. On either side of the interrupter assembly a series of arc dissipating structures, in the form of splitter plates 24 are positioned and separated from one another by air gaps 26. Below each stack of splitter plates, a variable or controllable resistance assembly 28 is positioned for directing current through an alternative or secondary current carrying path during interruption of the normal current carrying path, and for aiding in rapidly causing complete interruption of current through the device.

Figure 2:
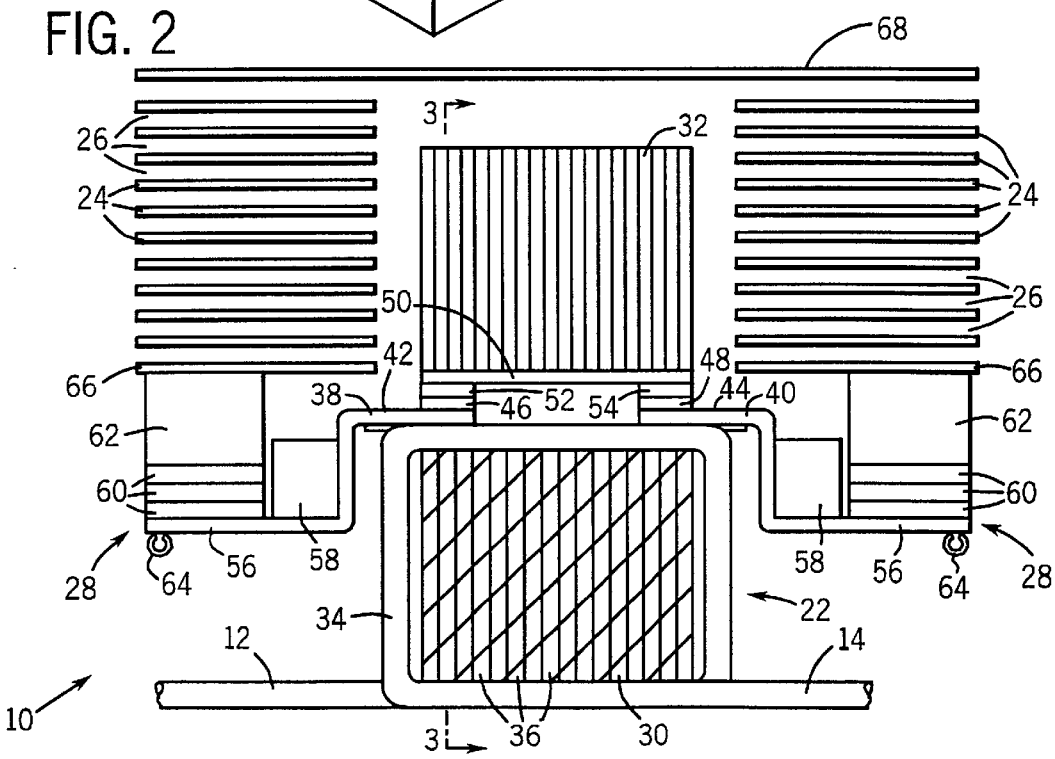
FIG. 2 is a sectional view through the assembly of FIG. 1, illustrating functional components of the assembly in a normal or biased position wherein a first current carrying path is established between the source and load.
Figure 3:
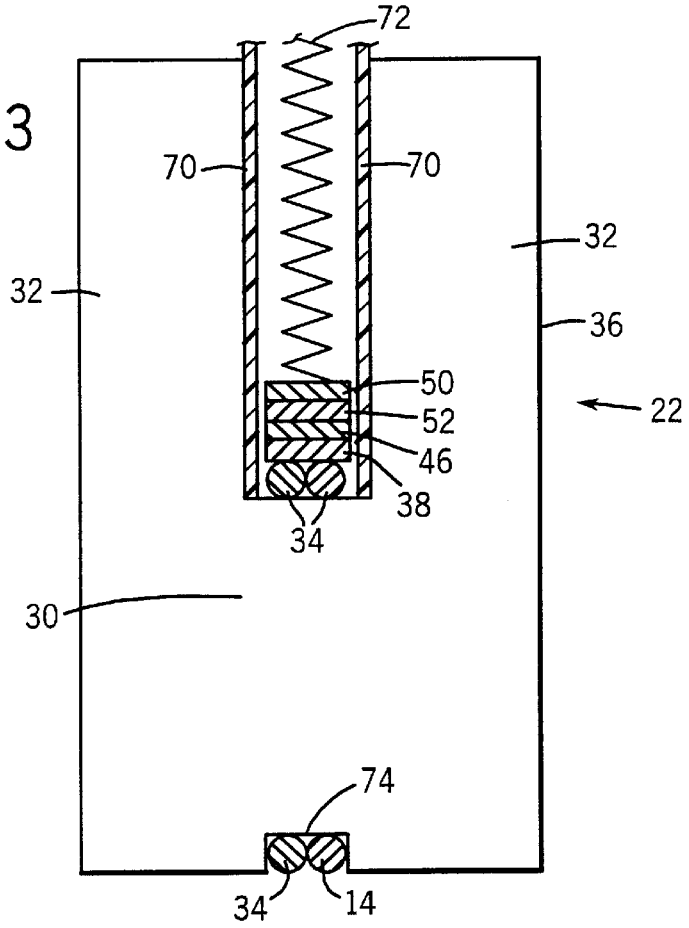
FIG. 3 is a transverse sectional view through a portion of the device of FIG. 1, illustrating the position of a movable conductive element in the device adjacent to a stationary conductive element.

FIG. 2 represents a longitudinal section through the exemplary device shown in FIG. 1. As illustrated in FIG. 2, initiator assembly 22 is formed of a unitary core having a lower core portion 30 and an upper core portion 32. Lower core portion 30 extends generally through the device, while upper core portion 32 includes a pair of upwardly-projecting elements or panels extending from the lower core portion 30. These upwardly-projecting elements are best illustrated in FIG. 3. In the illustrated embodiment, one of the conductors, such as conductor 14, is wrapped around lower core portion 30 to form at least one turn 34 around the lower core portion, as illustrated in FIG. 2. The turn or wrap around the core enhances an electromagnetic field generated during overload, overcurrent, and other interrupt-triggering events for initiating interruption. Lower and upper core portions 30 and 32 are preferably formed of a series of conductive plates 36 stacked and bound to one another to form a unitary structure. The individual plates in the core may be separated at desired locations by insulating members (not shown).

Conductors 12 and 14 are electrically coupled to respective stationary conductors 38 and 40 on either side of the initiator assembly. A variety of connection structures may be employed, such as bonding, soldering, and so forth. Each stationary conductor includes an upper surface which forms an arc runner, indicated respectively by reference numerals 42 and 44 in FIG. 2. Stationary contacts 46 and 48 are bonded to each stationary conductor 38 and 40, respectively, adjacent to the arc runners. In the embodiment illustrated in the Figures, the stationary conductors, the arc runners, and the stationary contacts are therefore at the electrical potential of the respective conductor to which they are coupled. A movable conductive element or spanner 50 extends between the stationary conductors and carries a pair of movable contacts 52 and 54. In a normal or biased position, the movable conductive spanner is urged into contact with the stationary conductors to bring the stationary and movable contacts into physical contact with one another and thereby to complete the normal or primary current carrying path through the device.

Each stationary conductor 38 and 40 extends from the arc runner to form a lateral extension 56. Each extension 56 is electrically coupled to a respective variable resistance assembly 28 to establish a portion of the alternative current carrying path through the device. In the illustrated embodiment, each variable resistance assembly includes a spacer 58, a series of variable or controllable resistance elements 60, a conductor block 62, a biasing member 64, and a conductive member 66. The presently preferred structure and operation of these components of the assemblies will be described in greater detail below. In general, however, each assembly offers an alternative path for electrical current during interruption of the normal current carrying path, and permits rapid interruption of all current through the device by transition of resistance characteristics of the alternative path. Splitter plates 24, separated by air gaps 26, are positioned above conductive member 66, and a conductive shunt plate 68 extends between the stacks of splitter plates.

Certain of the foregoing elements are illustrated in the transverse sectional view of FIG. 3. As shown in FIG. 3, the plates 36 of the lower and upper core portions 30 and 32 form a generally H-shaped structure. An insulating liner 70 may extend between the upper core portions 32 and turns 34, and the stationary, and movable contacts, to protect the core and turns from the arc. Liner 70 may include an extension of an internal peripheral wall of inner housing 18 shown in FIG. 1. A biasing member, such as a compression spring 72, is provided for urging the movable conductive spanner 50 into its normal or biased position to complete the normal current carrying path. As mentioned above, in this orientation, movable and stationary contacts (see contacts 54 and 48 in FIG. 3) are physically joined to complete the normal current carrying path. In the illustrated embodiment lower core portion 30 also forms a trough 74 in which conductor 14 and at least one extension of turn 34 of the conductor are disposed.

The foregoing functional components of interrupter module 10 may be formed of any suitable material. For example, plates 36 of the core portions may be formed of a ferromagnetic material, such as steel. Stationary conductors 38 and 40 may be formed of a conductive material such as copper, and may be plated in desired locations. Similarly, movable conductive element 50 is made of an electrically conductive material such as copper. The stationary and movable contacts provided on the stationary and movable conductive elements are also made of a conductive material, preferably a material which provides some resistance to degradation during opening and closing of the device. For example, the contacts may be made of a durable material such as copper-tungsten alloy bonded to the respective conductive element. Finally, conductive members 66, splitter plates 24 and shunt plate 68 may be made of any suitable electrically conductive material, such as steel.

Figure 4:
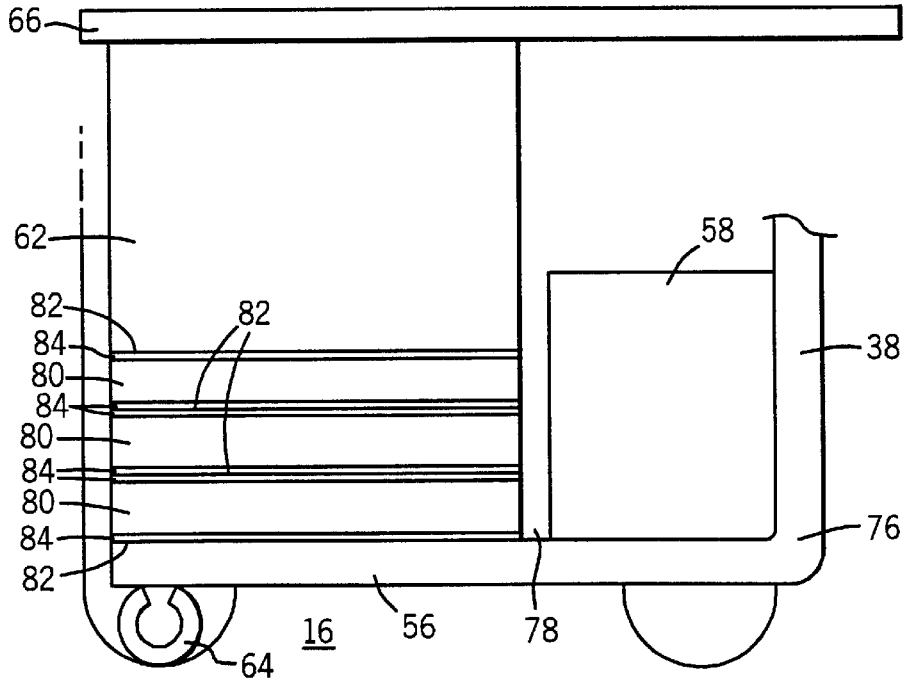
FIG. 4 is an enlarged detailed view of a portion of the device as shown in FIG. 2, including a variable resistance assembly for aiding in interrupting current through the device in accordance with certain aspects of the present technique.

The components of the variable resistance assemblies 28 are illustrated in greater detail in FIG. 4. In the illustrated embodiment, each stationary conductor, such as stationary conductor 38, includes a lower corner 76 formed between the arc runner (see FIG. 2) and the lateral extension 56. The lateral extension is generally supported by the inner housing 16. One or more variable resistance elements 60 are electrically coupled between each extension 56 and a respective conductive member 66, through the intermediary of a conductor block 62, if necessary. That is, where the spacing in the device requires electrical continuity to be assisted by such a conductive member, one is provided. Alternative configurations may be envisaged, however, where a conductor block 62 is not needed and electrical continuity between the stationary conductor and conductive member 66 is provided by the variable resistance elements alone. Moreover, in the illustrated embodiment, spacer 58, which is made of a non-conductive material, is positioned within the lower corner 76 between the lateral extension and a side or end surface of the variable resistance elements. In general, such spacers may be positioned in the device to reduce free volumes 78, or to change the geometry of such volumes, and thereby to limit or direct flow of gasses and plasma in the device during interruption. Again, where the geometry of the device sufficiently controls such gas or plasma flow, spacers of this type may be eliminated.

Electrical continuity between extensions 56 and conductive members 60 is further enhanced by biasing member 64. A variety of such biasing members may be envisaged. In the illustrated embodiment, however, the biasing member consists of a roll pin positioned between a lower face of lateral extension 56 and a trough formed in the inner housing. The biasing member forces the extension upwardly, thereby insuring good electrical connection between the extension, the variable resistance elements, and conductive member 66.

In the illustrated embodiment, a group of three variable resistance elements is disposed on either side of the initiator assembly. The variable resistance elements are electrically coupled to one another in series, and the groups of elements form a portion of the transient or alternative current carrying path through the device as discussed below. Depending upon the desired resistance in each of these assemblies, more or fewer such elements may be employed. Moreover, various types of elements 60 may be used for implementing the present technique. In the illustrated embodiment, each element 60 comprises a conductive polymer such as polyethylene doped with a dispersion of carbon black. Such materials are commercially available in various forms, such as from Raychem of Menlo Park, Calif., under the designation PolySwitch. In the illustrated embodiment, each of the series of three such elements has a thickness of approximately 1 mm. and contact surface dimensions of approximately 8 mm.×8 mm. In addition, to provide good termination and electrical continuity between the series of elements 60, each element body 80 may be covered on its respective faces 82 by a conductive terminal layer 84. Terminal layer 84 may be formed of any of a variety of materials, such as copper. Moreover, such terminal layers may be bonded to the faces of the element body by any suitable process, such as by electroplating.

While the conductive polymer material mentioned above is presently preferred, other suitable materials may be employed in the variable resistance structures in accordance with the present technique. Such materials may include metallic and ceramic materials, such as $BaTiO_3$ ceramics and so forth. In general, variable resistance elements such as elements 60 change their resistance or resistive state during operation from a relatively low resistance level to a relatively high resistance level. Commercially available materials, for example, change state in a relatively narrow band of operating temperatures, and are thus sometimes referred to as positive temperature coefficient (PTC) resistors. By way of example, such materials may increase their resistivity from on the order of 10 mΩcm at room temperature to on the order of 10 MΩcm at 120°–130° C. In the illustrated embodiment, for example, each element transitions during interruption of the device from a resistance of approximately less than 1 mΩ to a resistance of approximately 100 mΩ.

As discussed below, in particularly preferred embodiment of the present technique, the material employed for elements 60 serves as a source material for gases and chemicals which aid in further enhancing performance of the device. In particular, the elements preferably include a hydrocarbon-based polymer which undergoes surface ablation during heating as current is passed through the parallel or secondary current carrying path. The surface ablation causes rapid release of gases which migrate in a direction opposite to the direction of migration of the arcs. The gases are directed towards the arcs, causing the arcs to expand rapidly and to be maintained in a condition which forces further investment in the arcs during circuit interruption.

Moreover, the hydrocarbon polymer surface ablation releases gases which scavenge ions created by the arcs, forcing the creation of new ions to sustain the arcs. The voltage investment in maintaining the arcs is thus further increased to drive the current level through the device more rapidly to a null level. The scavenging of ions by deionization of the arcs also contributes to impedance balancing of the parallel current paths (i.e., through the arcs and through the splitter plate stack and air gaps).

Finally, as noted above, the surface ablation of the source elements aids in maintaining the arcs and in forcing expansion of the arcs due to the gas dynamic effect of the released gas on the migrating arcs. In fact, by appropriately channeling the ablated gas, the arcs are blown inwardly in a direction opposite to that of their migration under the influence of the electromagnetic field.

The performance of these elements during fault interruption is a function of time, current and heating that also depends on external circuit parameters which may vary. For example, under a typical 480 volt AC, 5 kA available conditions with 70% power factor, each element generates a back-EMF that rises smoothly from zero to approximately 72 volts at 1.5 ms after fault initiation and holds relatively constant thereafter until the fault current is terminated. As discussed more fully below, in the present technique, the elements pass no current during normal operation that is, as current is passed through the normal current carrying path in the device. Thus, during normal operation the elements do not offer voltage drop with normal load currents, but are part of an open, parallel secondary current carrying path.

Figure 5:
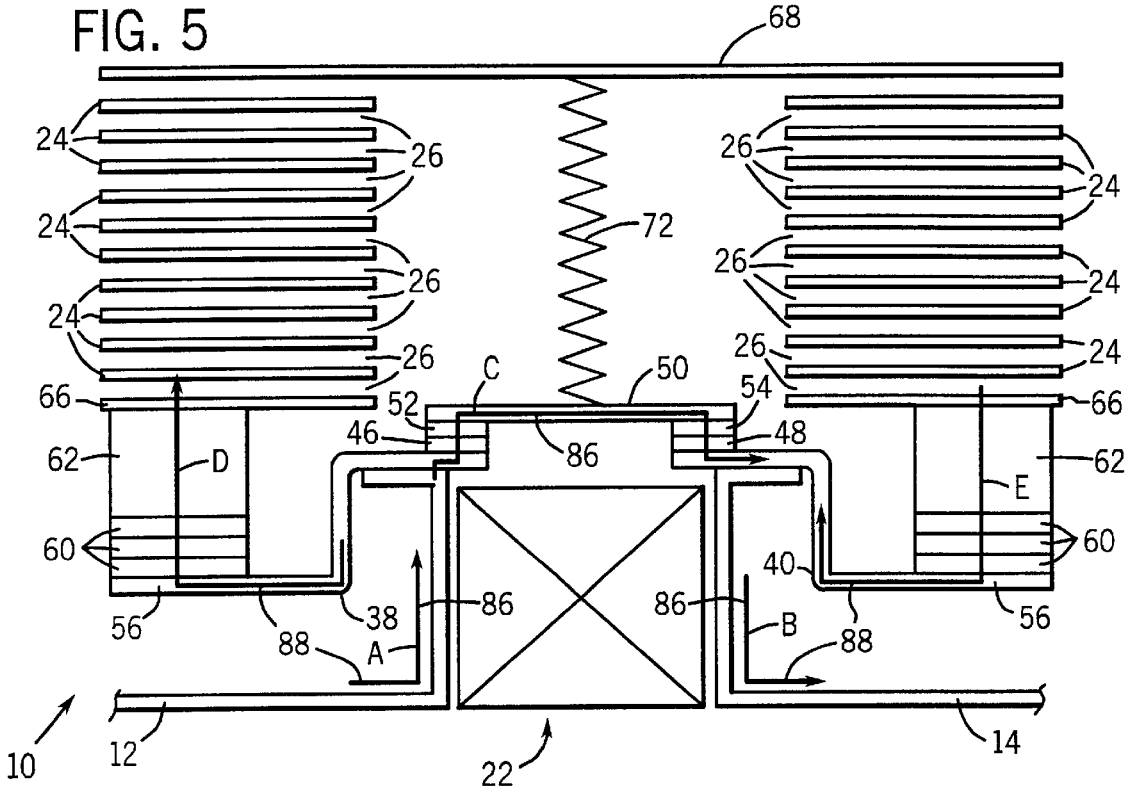
FIG. 5 is a diagrammatical representation of certain functional components illustrated in the previous figures, showing a normal or first current carrying path through the device as well as a transient or alternative current carrying path through the variable-resistance structures.
Figure 6:
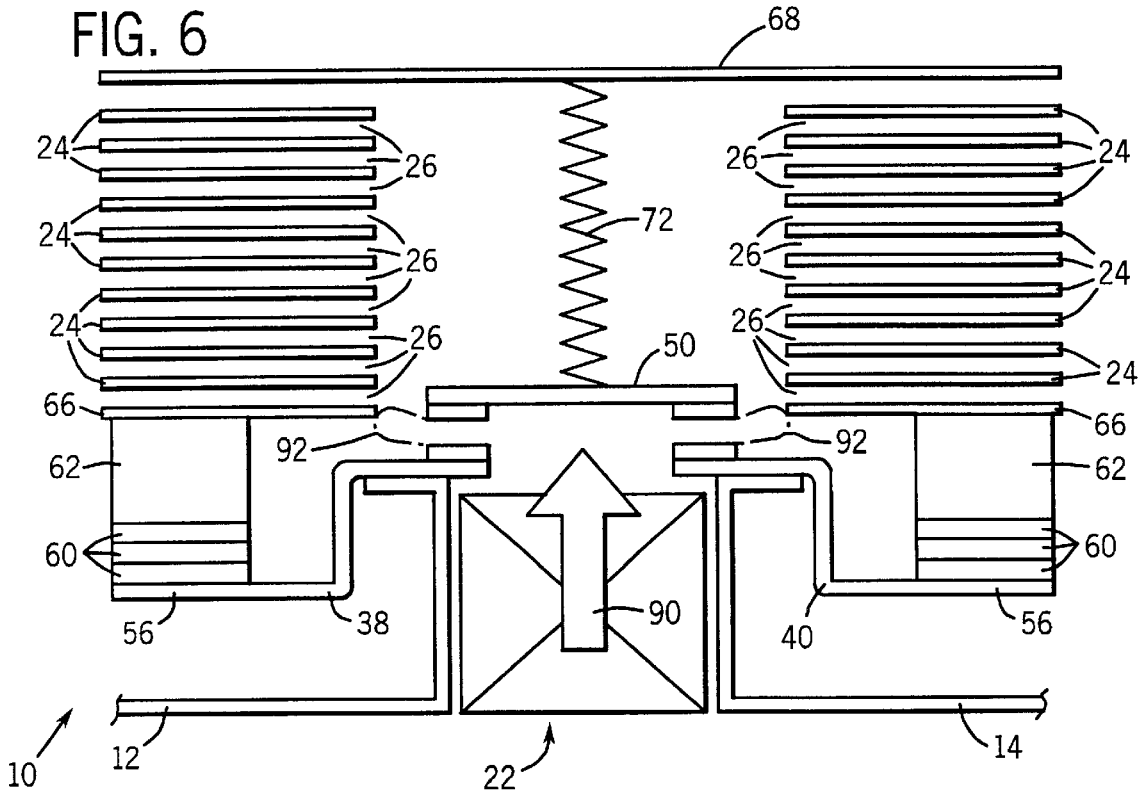
FIG. 6 is a diagrammatical representation of the functional components shown in FIG. 5 during a first phase of interruption of the normal current carrying path through the device.
Figure 7:
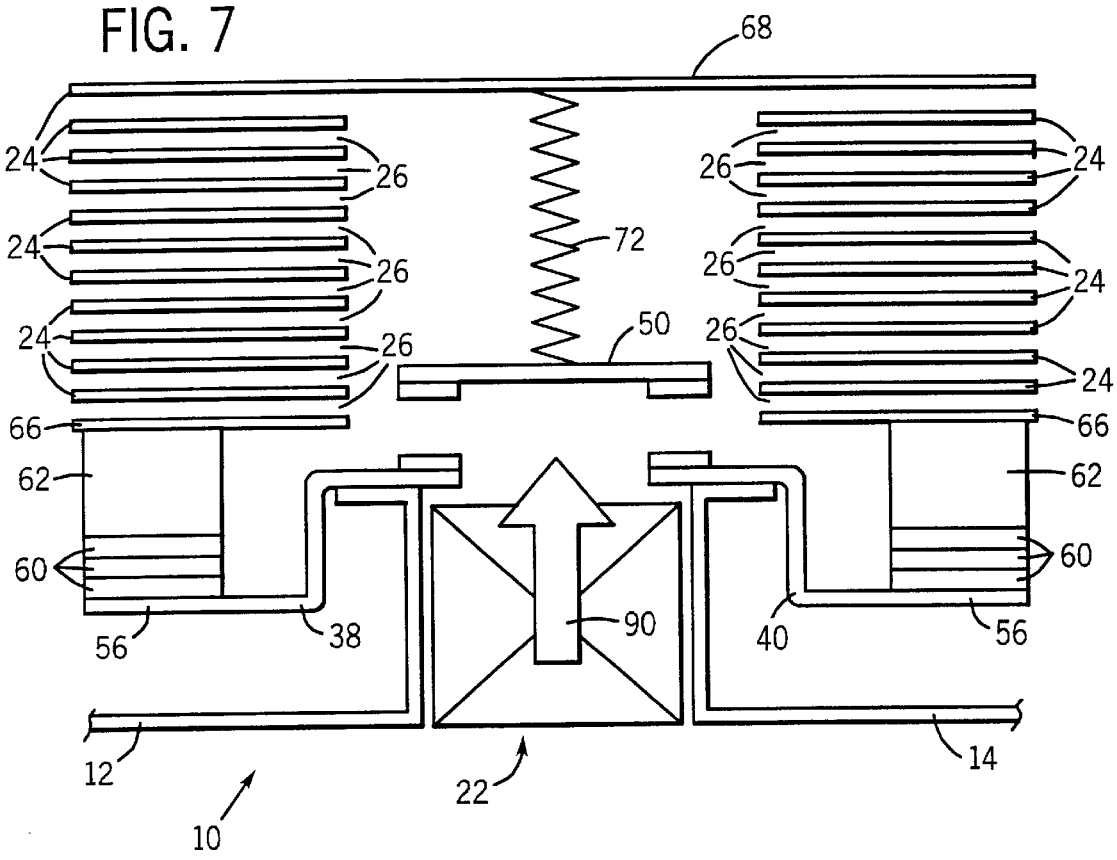
FIG. 7 is a diagrammatical representation of the functional components shown in FIG. 6 at a subsequent stage of interruption.

FIGS. 5, 6 and 7 illustrate current carrying paths through the device described above, both prior to and during interruption. As illustrated diagrammatically in FIG. 5, a normal or first current carrying path through the device, represented generally by reference numeral 86, includes segments A, B and C. Segment A includes conductor 12 extending up to and partially through stationary conductor 38. Similarly, section B includes conductor 14 and a portion of stationary conductor 40. It should be noted that the turn around the interrupt initiator assembly described above is not illustrated in FIGS. 5, 6 and 7 for the sake of simplicity. Section C of the normal current carrying path 86 is established by the stationary conductors 38 and 40, by movable conductive spanner 50, and the stationary and movable contacts disposed therebetween. Thus, during normal operation, current may flow freely between the source and load. The normal current carrying path is maintained by biasing of the movable conductive spanner against the stationary conductors.

A transient or alternative current carrying path is defined through the variable resistance assemblies described above. As illustrated in FIG. 5, this transient current carrying path, designated generally by the reference numeral 88, includes section A described above, as well as a section D extending through the extension 56 of stationary conductor 38, the variable resistance elements 60 associated therewith, the conductor block 62, if provided, and conductive member 66. The transient current carrying path then extends through the series of air gaps and splitter plates, and therefrom through shunt plate 68. Moreover, the transient current carrying path also is defined by section B described above, through conductor 14, and through extension 56 of stationary conductor 40, as well as through the variable resistance elements, conductor block and conductive member 66 associated therewith, as indicated by the letter E in FIG. 5. Thus, the alternative or transient current carrying path through the device extends between the source and load conductors, through the variable resistance assemblies, the splitter plates, air gaps, and shunt plate, these various components being electrically connected in series. It should be noted, however, that during normal operation, the resistance offered by the transient current carrying path, particularly by the air gaps between the splitter plates, forms an open circuit preventing current flow through the transient current carrying path, and forcing all current through the device to be channeled via the normal current carrying path 86.

Referring now to FIGS. 6 and 7, interruption of current flow through the device is illustrated in subsequent phases. From the normal or biased position of FIG. 5, interruption is initiated as shown in FIG. 6 by repulsion of the conductive spanner 50 from the stationary conductors or by any other suitable interrupt initiator. In the illustrated embodiment, this repulsion results from a strong electromagnetic field generated by the initiator assembly. As the conductive spanner 50 is moved from its normal or biased position, as indicated by arrow 90 in FIG. 6, arcs 92 form between the movable and stationary contacts of the spanner and stationary conductors. These arcs migrate from the contacts outwardly along the arc runners and contact conductive members 66 of each variable resistance assembly. At this initial phase of interruption, variable resistance elements 60 are placed electrically in parallel with a respective arc 92 and, following sufficient movement of the conductive spanner, offer a resistance to current flow between a respective stationary conductor and conductive member 66 to draw current into the alternative current carrying path. Current flow then transitions to both current carrying paths. As illustrated in FIG. 7, further movement of the conductive spanner may then proceed with complete interruption of the normal and alternative current carrying paths.

Figure 8A:
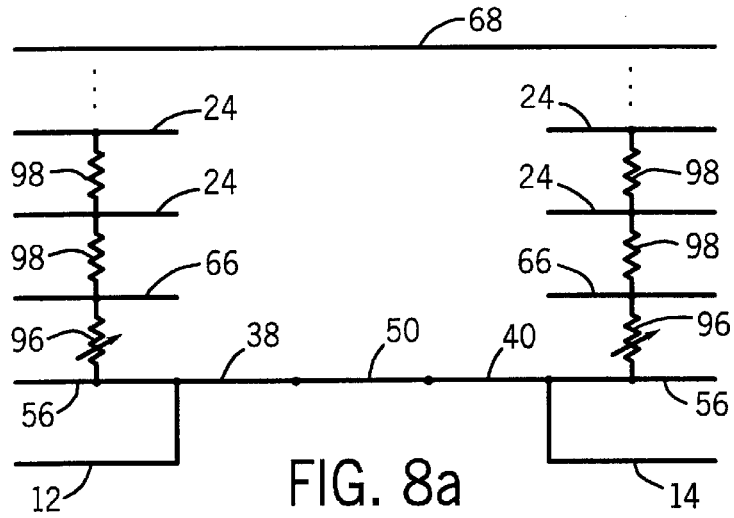
FIGS. 8*a*, 8*b*, 8*c*, 8*d* and 8*e* are schematic diagrams of equivalent circuits for the device in the; stages of operation shown in FIGS. 5, 6 and 7.

The interruption sequence described above is illustrated schematically in FIGS. 8*a*–8*e* through equivalent circuit diagrams. As shown first in FIG. 8*a,* with conductive spanner 50 in its biased position, the normal current carrying path is establish between conductors 12 and 14. The variable resistance assemblies, represented by variable resistors 96 in FIG. 8*a,* in combination with air gaps between conductive members 66 and splitter plates 24, represented by resistors 98 in the Figure, offer sufficient resistance to current flow to establish an open circuit through the transient current carrying path.

Figure 8B:
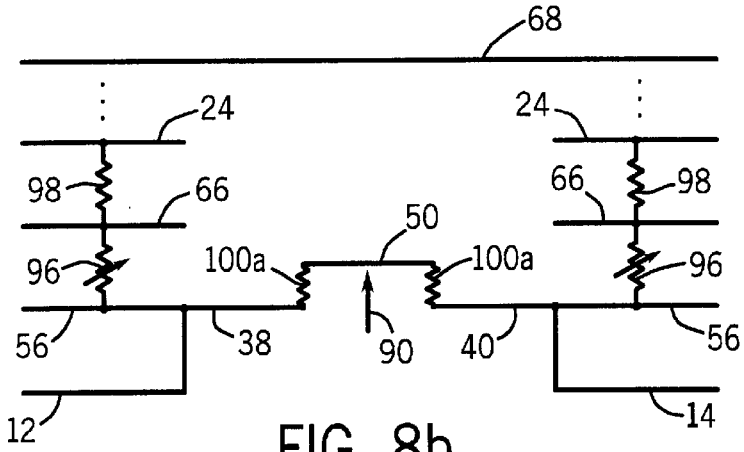
Figure 8C:
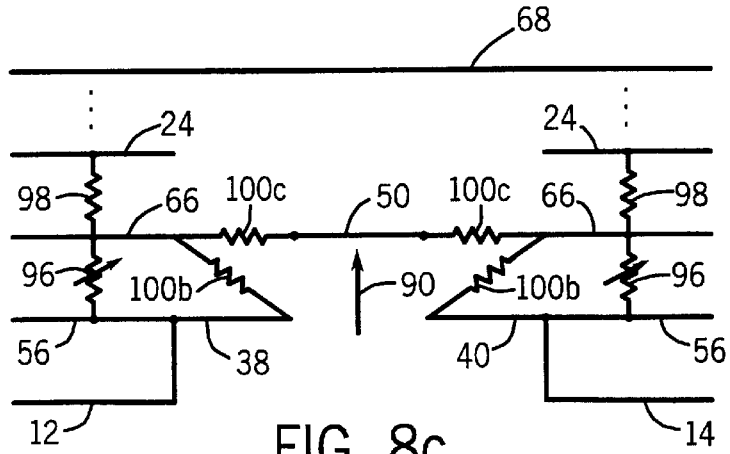

Upon initial interruption of the normal current carrying path, arcs established between the movable and stationary conductive elements define resistances 100*a* between the stationary conductors and spanner 50 as shown in FIG. 8*b*. At this stage of operation, resistors 96 defined by the variable resistance assemblies, remain at their relatively low resistivity levels. Subsequently, a shown in FIG. 8*c,* expanding arcs established between the stationary conductors 38 and 40, and spanner 50, extend to contact conductive members 66, to establish equivalent resistances 100*b* and 100*c* on each side of the device. It will be noted that equivalent resistances 100*b* established by the arcs are electrically in parallel with variable resistors 96. When the resistance offered by these assemblies, balanced with the resistance offered by the expanding and migrating arcs, favors transfer of a portion of the current flow through the transient current carrying path, the transient current carrying path begins conducting current through the device, in conjunction with the arcs.

Figure 8D:
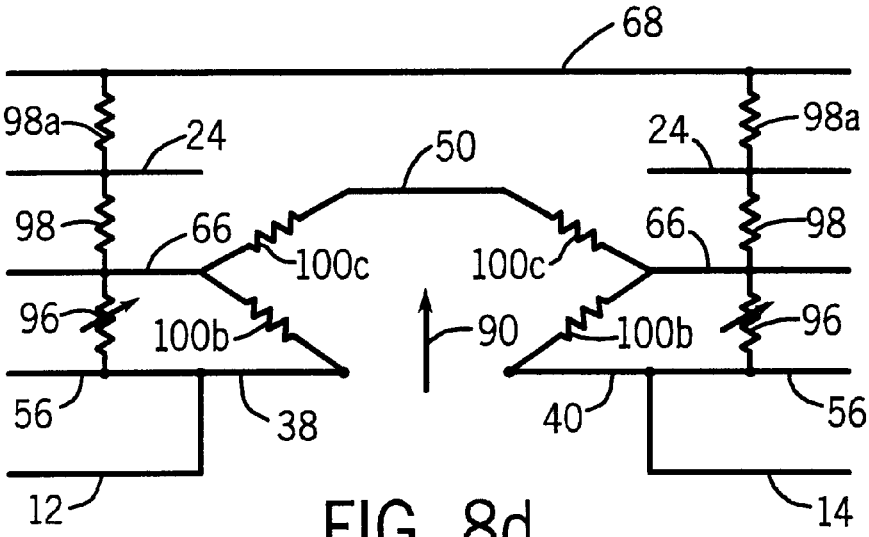
Figure 8E:
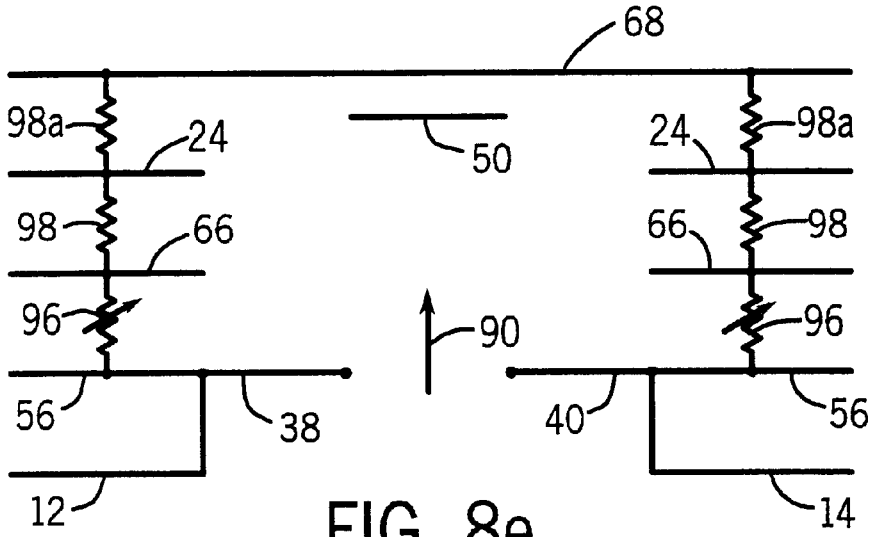

In a subsequent phase of interruption, illustrated schematically in FIG. 8*d,* current flows through both the normal and the transient current carrying paths. During this intermediate stage of interruption, the transient current carrying path extends through the variable resistors 96, through arcs 100*c* and through spanner 50, as well as through resistances 98, and shunt plate 68. These parallel current carrying paths eventually terminate current flow, with current flow terminating through the spanner 50 upon extinction of arcs 100*b* and 100*c*. Such termination of current flow through the normal current carrying path (established by arcs 100*b*) may occur before termination of current through the transient path. As the spanner is displaced further in its movement, as indicated by arrow 90, interruption is eventually completed, terminating all current flow through the device, as indicated in FIG. 8*e*.

With heating during these progressive phases of interruption, the variable resistance assemblies transition to their higher resistivity level. In the illustrated embodiment, for example, each variable resistance assembly provides, in the subsequent phase of interruption, a voltage drop of approximately 75 volts. Each air gap between the splitter plates, indicated at reference numeral 98 in FIGS. 8*a,*–8*e,* provides an additional 17 volts of back-EMF. A total back-EMF is provided in an exemplary structure, therefore, of approximately 900 volts, of which approximately 150 volts is provided by the variable resistance elements. It is believed that in the current structure, certain of the upper splitter plates and shunt plate 68 may contribute little additional back-EMF for interruption of current through the device. However, it is currently contemplated that one or more variable resistors comprising one or more layers of material, such as that defining assemblies 28, may be added at upper levels in the transient current-carrying path to provide additional assistance in establishing back-EMF and interrupting current flow.

Figure 9:
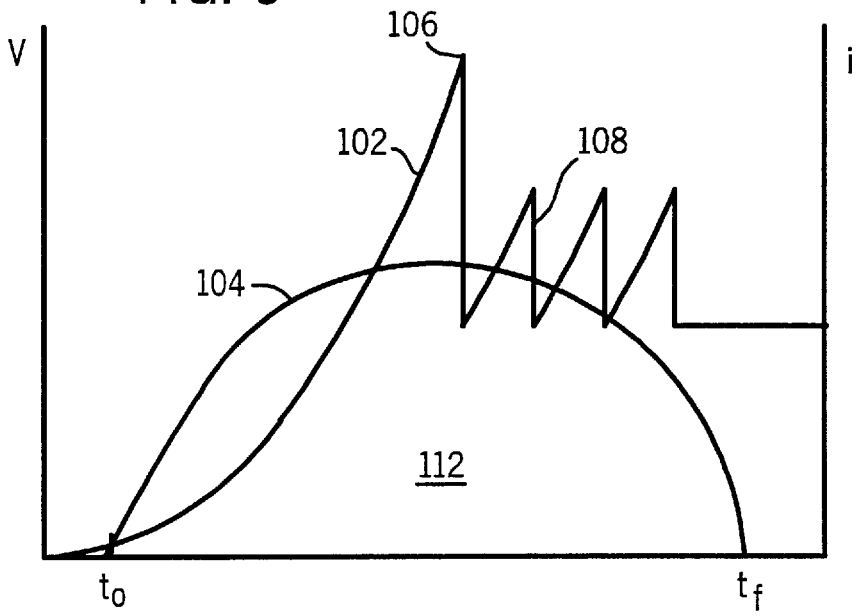
FIG. 9 is a graphical representation of voltage and current traces during interruption of an exemplary conventional circuit interrupter.
Figure 10:
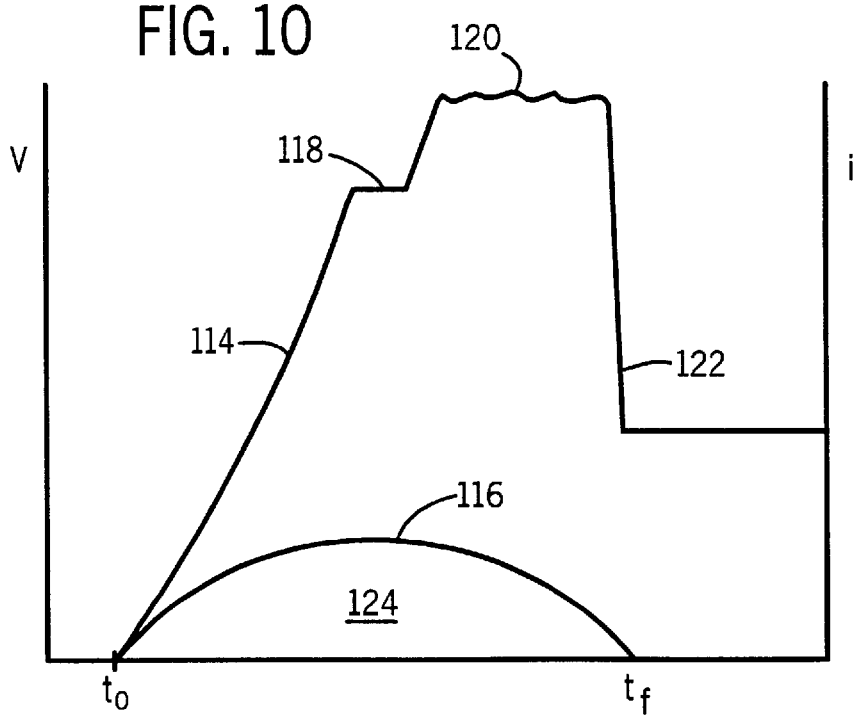
FIG. 10 is a graphical representation of exemplary voltage and current traces during interruption of a device in accordance with the present technique.

It has been found that the present technique offers superior circuit interruption, reducing times required for driving current to a zero level, and thereby substantially reducing let-through energy. Moreover, it has been found that the technique is particularly useful for high voltage (e.g. 480 volts) single phase applications. FIGS. 9 and 10 illustrate a contrast between the performance of conventional circuit interrupters and performance of the exemplary structure described above.

As shown in FIG. 9, where circuit interruption begins at a time $t_0$, a back-EMF voltage trace 102 in a conventional device rises sharply, as does a trace of current 104 through a splitter plate and shunt bar arrangement. The back-EMF voltage reaches a peak 106, then declines and oscillates as shown at reference numeral 108. In exemplary tests of a single phase device, with a 480 volt source, an available current of approximately 8,000 Amps, and a power factor of approximately 60%, a clearing time ($t_0$ to $t_f$) of approximately 3.8 ms was obtained. A peak back-EMF was realized at a level of approximately 913 volts. Let-through energy, represented generally at reference numeral 112 in FIG. 9 was approximately $10.7\times10^4 A^2s$.

As illustrated in FIG. 10, a back-EMF voltage trace 114 for an interrupter of the type described above exhibits a similar rise following initiation of interruption at time $t_0$, while a trace of current 116 rises significantly more slowly than in the conventional case. Moreover, the voltage trace reaches an initial level 118, followed by a further rise to a higher sustained peak, as indicated at reference numeral 120, before falling off with the decline of current to a zero level at time $t_f$, as indicated at reference numeral 122. In exemplary tests, with similar conditions to those set forth above, a clearing time of approximately 2.72 ms was obtained, with a peak back-EMF of 1010 volts. Let-through energy, represented generally at reference numeral 124, was approximately $7.60\times10^3 A^2s$.

The particular performance and let-through energy limiting features of the present technique will, of course, vary with the particular interrupter design, and the physics of the establishment of arcs and current paths in the device resulting from the design. For example, while in the foregoing discussion, the description was based upon a light-weight movable spanner 50, more conventional devices may also benefit from the parallel current-carrying path established by virtue of the positioning of the variable resistance devices in the splitter plate stack, or in a similar location. Moreover, while the foregoing discussion was based upon a variable resistance device having a relatively sharp transition point between resistance states, more linearly-varying devices may be employed, such as carbon or graphite.

As regards the specific material selected for the variable resistance elements, it is believed that the surprisingly rapid extinction of arcs and the interruption of current in the present device may be optimized through behavior of the specific material. For example, fault current through the variable resistance elements may reduce the current through the parallel arc and the corresponding arc voltage may thereby be caused to increase owing to negative resistance characteristics of the arcs. Moreover, described below, partial ablation of a surface of the variable resistance element may generate gas flow which tends to oppose the magnetically driven motion of the parallel arc into the splitter plate stack, again increasing its voltage by forcing higher investment of electrical energy to compensate for the loss of charged carriers (e.g., positive ions and free electrons). Moreover, gasses evolved during such ablation may be chemically active in promoting faster recombination of electrons and ions, having an effect equivalent to gas dynamically blowing the electrons and ions away from the arc path. However, it is believed that at least a portion of the benefits demonstrated with the foregoing structure and method may be obtained through the use of various resistance materials in the manner described.

In addition to establishing a transient or alternative current carrying path for rapidly interrupting current through the device as described above, the present technique serves to reduce or eliminate arc retrogression during interruption. As will be appreciated by those skilled in the art, arc retrogression is a common and problematic failure mode in circuit breakers and other circuit interrupters, particularly under high voltage, single-phase conditions. In this failure mode, parasitic arcs external to the splitter plate stack provide parallel paths to arcs within the splitter plate stacks. Arc retrogression is believed to be caused by residual ionization resulting from prior arcing, and from strong electric fields due to high back-EMF concentrations. When new arcs are initiated, back-EMF drops precipitously and older arcs in the splitter plate stack are extinguished as current transfers to the new lower voltage, lower resistance arc. The new arc then folds into the splitter plate stack, increasing its back-EMF until the retrogression threshold is reached again and the process is repeated, giving rise to a characteristic high frequency voltage oscillation, as indicated by the oscillating voltages 108 in FIG. 9. As a result of such oscillations, the average back-EMF through the successive retrogression cycles is lower than it would be without such cycles, prolonging the process of driving the current to a zero level, and permitting additional let-through energy.

Through the present technique, such retrogression is significantly reduced or eliminated. In particular, the use of the variable or controlled resistance material in the transient current carrying path, provides additional back-EMF, removing some of the load from the splitter plate stack which can then operate below the retrogression threshold and circumvent the retrogression-related voltage oscillations. The use of the material adjacent to the core in the preferred embodiment also redistributes the back-EMF within the device, shifting an additional portion of the back-EMF to a location adjacent the core where magnetic field density is greater and aids in opposing retrogression by raising its threshold.

As noted above, additional variable resistance elements may be provided at elevated levels in the transient current carrying path. Such additional structures are believed to enable further reduction in the occurrence of retrogression. In particular, prior to transition of the materials to an elevated resistance level, they provide a short circuit or lower resistance paths, preventing the retrogression effects. Upon heating and transition to a higher resistance level, such structures would provide additional sources of back-EMF to assist in driving the fault current to a zero level. It is also noted that because a time delay is inherent in conversion of the additional structures from one resistance level to another by heating, such delays would permit residual ionization (associated with arc commutation to the splitter plates adjacent to such variable resistance structures) to decay somewhat before the electric field subsequently appears. As the level of residual ionization decreases, the electric field or voltage per unit length required to initiate retrogression increases. Thus, the delay in transition of the material to a higher resistance level permits a higher back-EMF to be eventually applied to more rapidly bring the fault current to a zero level without initiating unstable arc retrogression.

In addition to the influence on arc retrogression, the inclusion of the elements 60 within the transient current carrying path provides sources for compounds which tend to deionize arc plasma, forcing further voltage investment in the arcs due to the recreation of ions. In general, the source material, preferably a hydrocarbon based material such as polyethylene, provides hydrocarbon radicals which exhibits incomplete bonds. Because the arc plasma includes free electrons and positively charged ions, these are scavenged by the ablated material from the source elements, being replaced by new ions created to sustain the arcs, and resulting in higher voltage investment in the arcs.

It should be noted that, as discussed above, source elements may be placed in various locations in the device. In the preferred embodiment illustrated, the source elements are placed in a location so as to establish a parallel path with the arcs as they expand during circuit interruption. However, other source elements for deionizing the arc plasma may be placed at alternative locations, such as on or between the splitter plates within the stacks. Moreover, other source element disposition techniques may be employed, such as partially or fully coating one or more of the splitter plates with a source compound, such as polyethylene, for a hydrocarbon-containing coating. In such cases, the nature of the deionization is similar, with the source material undergoing surface ablation to release the deionizing compound, forcing new ions to be created by the arcs, and raising the voltage investment in the arcs.

Figure 11:
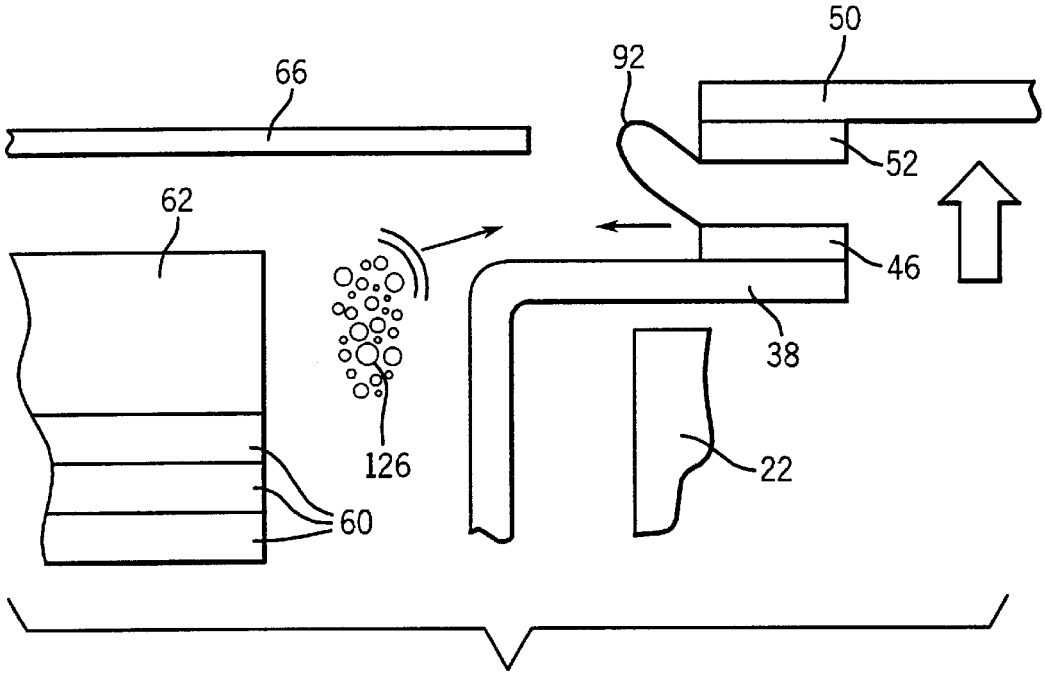
FIG. 11 is a detailed representation of the migration of an arc during interruption of a device opposed by gases released during surface ablation of a source element.

As noted above, the provision of elements 60, and the use of materials for elements which undergo surface ablation during interruption, provides expanding gases which have a gas dynamic effect upon migration of the arcs. In particular, in the illustrated embodiment, surface ablation of the elements causes rapid expansion of the ablated material, forcing gases through the opening between the stationary conductors 38 and 40 and the splitter plate stack, specifically between the stationary conductors and the lower-most splitter plate 66. FIG. 11 illustrates the migration of an arc 92 as it expands by motion of the spanner 50 as discussed above, counteracted by expanding gases from elements 60 acting as a source material for ablated gas. As shown in FIG. 11, during initial displacement of spanner 50, an arc 92 expands between the moveable and stationary contacts 52 and 46 on a left side of the device as illustrated. It should be noted that a similar interaction occurs on the opposite side of the device where two moveable contacts are provided. Under the influence of the electromagnetic field created by element 22, arc 92 is forced to migrate toward the splitter plate stack. At the same time, heating of the source element 60 causes surface ablation which releases rapidly-expanding gas. The gas is channeled into the path of the migrating arc. The gas, designated generally by reference numeral 126 in FIG. 11 thus opposes migration of the arc, causing the arc to remain resident outside the splitter plates and forcing further investment in the arc as it expands.

It should be noted that the expanding gas may be channeled in a wide variety of manners. In the illustrated embodiment, elements 38, 66, and the surrounding sidewalls of the device (see, e.g., FIGS. 1 and 3) aid in directing and guiding the expanding gas into the path of the arcs. Additional, specialized structures may be provided for sufficiently directing the gas into the arc path.

As noted above, the present techniques for reducing arc retrogression, for deionizing arcs via a source element, and for gas dynamically opposing migration of an arc, may be incorporated into various structures. These may include designs in which a source element is placed near a single moveable contact which is designed to be separated from a single stationary contact. The techniques may also be employed in structures wherein a pair of moveable contacts are separated from one another. Finally, the technique may find applications in both single and multi-phase devices.

It should also be noted that the use of a resistance-transitioning material for elements 60 serves to protect the elements from damage during interruption, allowing the surface ablation useful in enhancing performance to occur repeatedly over the life of the device. Thus, sufficient surface ablation occurs to permit the enhanced effects described herein, but as the resistance level of the elements increases, a current through the elements is limited, effectively protecting the devices from damage which could result from excessive current. As also noted above, the elements are preferably selected so as to provide a desired resistance level, to supplement the inherent resistance of the air gaps in the parallel current carrying path, and will typically be defined by the inherent qualities of the material, the number of elements utilized, their cross sectional area, and so forth.

While the invention may be susceptible to various modifications and alternative forms, specific embodiments have been shown and described herein by way of example only. It should be understood that the invention is not intended to be limited to the particular forms disclosed. Rather, the invention is to cover all modifications, equivalents and alternatives falling within the spirit and scope of the invention as defined by the following appended claims. For example, those skilled in the art will readily recognize that the foregoing innovations may be incorporated into various forms of switching devices and circuit interrupters. Similarly, certain of the present teachings may be used in single-phase devices as well as multi-phase devices, and in devices having different numbers of poles, and various arrangements for initiating circuit interruption. Moreover, the present technique may be equally well employed in interrupters having a single movable contact element or multiple movable elements. As mentioned above, the variable resistance elements and assemblies may be placed in different locations of the transient current carrying path described, including in locations above the stationary conductors, such as adjacent to or in place of the shunt bar, for example.

What is claimed is:

1. A method for extinguishing an arc in a circuit interrupter, the method comprising the steps of:

separating first and second contacts from one another to generate an arc between the contacts;

magnetically driving the arc in a first direction towards an arc dissipating structure;

ablating a source material to create a gas flow; and directing the gas flow towards the arc in a second direction generally opposed to first direction.

2. The method of claim 1, wherein the first and second contacts are separated by a field developed around an electromagnetic core, and wherein the arc is driven in the first direction by the field.

3. The method of claim 1, wherein the source material is provided in a current carrying path electrically in parallel to the first and second contacts.

4. The method of claim 3, wherein the source material carries no current prior to separation of the first and second contacts.

5. The method of claim 1, wherein the first contact is a stationary contact and the second contact is a movable contact.

6. The method of claim 1, wherein the source material is ablated by heating due to current flow through the source material.

7. The method of claim 6, wherein the source material transitions from a first resistance level to a second resistance level higher than the first resistance level due to heating during operation.

8. The method of claim 1, wherein the source material includes a polymeric body and wherein ablation occurs along exposed surface of the body.

9. A method for extinguishing an arc in a circuit interrupter, the method comprising the steps of:

separating a pair of contacts in a primary current carrying path to form an arc between the contacts;

magnetically driving migration of the arc towards an arc dissipating structure;

ablating a source material under the influence of current through a secondary current carrying path electrically in parallel with the primary current carrying path; and directing gas generated by ablation of the source material in opposition to migration of the arc to aid in extinguishing the arc.

10. The method of claim 9, wherein the contacts are separated by a field generated by an interrupt initiation device, and wherein migration of the arc is driven by the field.

11. The method of claim 9, wherein the secondary current carrying path conducts no current prior to separation of the contacts.

12. The method of claim 9, wherein the source material is ablated by heating resulting from current through the secondary current carrying path.

13. The method of claim 12, wherein the source material transitions from a first resistance level to a second resistance level higher than the first resistance level due to heating.

14. The method of claim 13, wherein the transition from the first resistance level to the second resistance level limits current through the secondary current carrying path.

15. A method for extinguishing arcs in a circuit interrupter, the method comprising the steps of:

biasing a movable conductive element into contact with a pair of stationary contacts;

displacing the movable conductive element to create arcs between the element and the stationary contacts;

magnetically driving migration of the arcs;

ablating source material adjacent to the arcs; and opposing migration of the arcs by directing gas generated by ablation of the source material.

16. The method of claim 15, wherein the movable conductive element is displaced by an electromagnetic interrupt initiator, and wherein migration of the arcs is driven by a field generated by the initiator.

17. The method of claim 15, wherein the arcs are driven in two mutually opposed directions, and wherein the source material includes two elements, one element being disposed adjacent to each stationary contact.

18. The method of claim 15, wherein the source material is disposed in a secondary current carrying path electrically in parallel with a primary current carrying path through the stationary contacts and the movable conductive element.

19. The method of claim 18, wherein the source material is ablated by heating from current flow through the secondary current carrying path.

20. The method of claim 19, wherein the source material transitions from a first resistance level to a second resistance level higher than the first resistance level due to heating from current flow through the secondary current carrying path.

21. A circuit interrupter comprising:

a pair of separable contacts, the contacts generating an arc upon separation;

an electromagnetic field source adapted to generate a magnetic field to drive migration of the arc upon separation of the contacts; and a gas source adapted to undergo surface ablation to produce a gas directed generally in opposition to migration of the arc and thereby to aid in extinction of the arc.

22. The circuit interrupter of claim 21, wherein the electromagnetic field source includes an electromagnet and wherein the electromagnet is adapted to urge separation of the contacts.

23. The circuit interrupter of claim 21, wherein the contacts are provided in a primary current carrying path through the interrupter, and wherein the gas source is provided in a secondary current carrying path through the interrupter electrically in parallel with the primary current carrying path.

24. The circuit interrupter of claim 23, wherein the second current carrying path carries no current prior to separation of the contacts.

25. The circuit interrupter of claim 23, wherein the gas source undergoes surface ablation as a result of current through the gas source during separation of the contacts.

26. The circuit interrupter of claim 25, wherein the gas source transitions from a first resistance level to a second resistance level higher than the first resistance level due to heating from current through the gas source during separation of the contacts.

27. The circuit interrupter of claim 21, wherein the gas source includes a conductive element having a polymeric body.

28. A circuit interrupter comprising:

an electromagnetic;

a primary current carrying path including at least one stationary contact and at least one movable contact, the movable contact being separable from the stationary contact under the influence of the electromagnet; and a secondary current carrying path electrically in parallel with the primary current carrying path and including a source material;

wherein the electromagnet is configured to drive migration of an arc generated during separation of the contacts toward the source material and the source material is adapted to ablate to produce a gas flow opposing migration of the arc.

29. The circuit interrupter of claim 28, wherein the electromagnet is configured to initiate displacement of the movable contact.

30. The circuit interrupter of claim 28, wherein the secondary current carrying path carries no current when the stationary and movable contacts are closed.

31. The circuit interrupter of claim 28, wherein the secondary current carrying path includes a plurality of splitter plates, and wherein the electromagnet drives migration of the arc towards the splitter plates.

32. The circuit interrupter of claim 28, wherein the source material transitions from a first resistance level to a second resistance level higher than the first level due to heating from current flow during separation of the contacts.

33. A circuit interrupter comprising:

an electromagnetic field source;

a first current carrying path including a pair of stationary contacts disposed adjacent to the field source and a conductive spanner displaceable between a closed position in contact with the stationary contacts and an open position separated from the stationary contacts; and a second current carrying path electrically in parallel with the first current carrying path and including a pair of ablative gas elements, one ablative gas element being disposed adjacent to each stationary contact;

wherein the electromagnetic field source is configured to displace the spanner towards the open position and to drive migration of arcs between the spanner and the stationary contacts towards the ablative gas elements, and wherein the ablative gas elements are configured to release gas in opposition to migration of the arcs.

34. The circuit interrupter of claim 33, wherein the second current carrying path includes a series of splitter plates electrically in series with the ablative gas elements and carries no current when the movable element is in the closed position.

35. The circuit interrupter of claim 34, wherein ablative gas elements release the gas from surface ablation due to current flow through the second current carrying path during separation of the contacts.

36. The circuit interrupter of claim 35, wherein the ablative gas elements transition from a first resistance level to a second resistance level higher than the first resistance level due to heating from current flowing through the second current carrying path.

* * * * *